US006190816B1

(12) United States Patent
Takehara et al.

(10) Patent No.: US 6,190,816 B1
(45) Date of Patent: Feb. 20, 2001

(54) TONER RESIN COMPOSITION AND TONER

(75) Inventors: Hiroaki Takehara; Takashi Ueyama; Masazumi Okudo, all of Shiga-ken (JP)

(73) Assignee: Sekisui Chemical Co., Ltd., Osaka (JP)

( * ) Notice: Under 35 U.S.C. 154(b), the term of this patent shall be extended for 0 days.

(21) Appl. No.: 09/412,748

(22) Filed: Oct. 5, 1999

(30) Foreign Application Priority Data

Oct. 5, 1998 (JP) ..... 10-282721
Apr. 13, 1999 (JP) ..... 11-105427

(51) Int. Cl.[7] ..... G03G 9/087
(52) U.S. Cl. ..... 430/110; 430/107
(58) Field of Search ..... 430/106, 107, 430/109, 137, 110; 525/221

(56) References Cited

U.S. PATENT DOCUMENTS

| | | | | |
|---|---|---|---|---|
| 5,229,242 | | 7/1993 | Mahabadi | 430/106.6 |
| 5,424,162 | | 6/1995 | Kohri | 430/110 |
| 5,474,871 | | 12/1995 | Takagi | 430/137 |
| 5,718,999 | * | 2/1998 | Suzuki et al. | 430/107 |
| 5,849,848 | * | 12/1998 | Kosaka et al. | 525/221 |

FOREIGN PATENT DOCUMENTS

| | | |
|---|---|---|
| 376717 | 7/1990 | (EP) . |
| 2212598 | 8/1990 | (JP) . |
| 3169846 | 7/1991 | (JP) . |

OTHER PUBLICATIONS

Database WPI, Section Ch, Week 199237, Derwent Publications, Ltd. & JP 04 198948 A (Fuji Xerox).

Patent Abstracts of Japan, vol. 12, No. 214 (P–718) Jun. 18, 1988 & JP 63 011948A Jan. 19, 1988, Abstract.

* cited by examiner

*Primary Examiner*—John Goodrow
(74) *Attorney, Agent, or Firm*—Townsend & Banta

(57) ABSTRACT

A toner resin composition composed of a vinyl-type copolymer which has styrene-type monomers and (meth)acrylic ester-type monomers as the main ingredients, a low-melting-point crystalline compound, and a block compolymer of polystyrene and polyolefin wherein the average particle area is 0.5–20 $\mu m^2$ and the maximum particle area is 30 $\mu m^2$ or less in any 25 $\mu m \times 25$ $\mu m$ area when transmission electron microscopy is used to observe said low-melting-point crystalline compound which forms domains in the domain-matrix structure formed by said vinyl-type copolymer and the low-melting-point crystalline compound.

To provide a toner resin composition and toner which have superior fixability, anti-offset properties, and shelf stability.

12 Claims, No Drawings

TONER RESIN COMPOSITION AND TONER

RELATED APPLICATION

This application claims the priority of Japanese Patent application No. 10-282721 filed on Oct. 5, 1998, and No.11-105427 filed on Apr. 13, 1999, which are incorporated herein by reference.

BACKGROUND OF THE INVENTION

1. Field of the Invention

The present invention relates in general to a toner resin composition and toner used in electrophotography and such, and more particularly to a toner resin composition and toner used in the so-called dry developing method for developing electrostatic charge images.

2. The Prior Art

The dry developing method is widely used to develop electrostatic charge images in electrophotography. In the dry developing method, toner is usually electrified by means of friction with iron powder, glass beads, etc., which are called carriers, and then attached to electrostatic latent images on the photosensitive matter due to electrical attraction, transferred to the paper sheet, and then fixed by heating rollers and such to form permanent visible images.

For the fixing process, the heating roller method is widely used in which the toner images on said sheet are pressed onto the surface of the heating roller, which has a toner-separating material formed on its surface, as the sheet goes through.

In the heating roller method, a toner resin composition which can be fixed at a lower temperature is desirable so as to improve cost efficiency, including power consumption, and increase the copying speed.

Toner resins which contain low molecular weight or low viscosity ethylene-type wax for improved fixability and anti-offset properties have been disclosed (Japanese unexamined patent publication Tokkai Hei 7-36218 and Tokkai Hei 8-114942).

However, they have a problem in that the shelf stability is poor due to the use of the ethylene-type wax.

Regarding shelf stability, it is known that the dispersibility of the low-melting-point crystalline compound present in the toner significantly affects the toner performance. Many patent applications have already been filed pertaining to the dispersion of the separability agent in toner (Tokkai Hei 9-211889, Tokkai Hei 2-27363, Tokkai Hei 3-296067, Tokkai Hei 4-69664, Tokkai Hei 9-288370, Tokkai Hei 9-288371, Tokkai Hei 9-288372, etc.). However, these methods only control the melt-kneading conditions at the time of making toner and their effect on dispersing the separability agent is not sufficient.

That is, when a toner resin composition with a low-melting-point crystalline compound whose dispersion is not controlled is tonerized under certain kneading conditions, the dispersion becomes somewhat finer, but there is a problem in that the distribution of dispersion particle size is wide, making it impossible to obtain toner with a homogeneous dispersion particle size. Tokkai Hei 6-175396 discloses a method to control the dispersion by grafting styrene-type monomers to polyethylene wax to control the dispersion; however, the degree of crystallization of the polyethylene wax was reduced due to the grafting and the shelf stability became poor, and therefore the basic performance of the toner was not satisfactory.

The present invention solves the aforementioned problem and its object is to provide a toner resin composition with superior fixability, anti-offset properties and shelf stability, as well as a toner which uses said toner resin composition.

BRIEF SUMMARY OF THE INVENTION

The toner resin composition of the present invention is a toner resin composition composed of a vinyl-type copolymer which has styrene-type monomers and (meth)acrylic ester-type monomers as the main ingredients, a low-melting-point crystalline compound, and a block compolymer of polystyrene and polyolefin wherein said vinyl-type copolymer has at least one peak value in both the range of 5,000–20,000 and the range of 500,000 or higher in the molecular weight distribution curve measured by gel permeation chromatography, the amount of said low-melting-point crystalline compound is 2–10 weight parts for 100 weight parts of said vinyl-type copolymer, the amount of said block copolymer is 0.5–5 weight parts for 100 weight parts of said vinyl-type copolymer, which toner resin composition having the characteristics that the average particle area is 0.5–20 $\mu m^2$ and the maximum particle area is 30 $\mu m^2$ or less in any 25 $\mu m \times 25$ $\mu m$ area when transmission electron microscopyl is used to observe said low-melting-point crystalline compound which forms domains in the domain-matrix structure formed by said vinyl-type copolymer and the low-melting-point crystalline compound.

DETAILED DESCRIPTION OF THE INVENTION

The present invention is described below.

The toner resin composition of the present invention is composed of a vinyl-type copolymer which has styrene-type monomers and acrylic ester-type monomers as the main ingredients, a low-melting-point crystalline compound, and a block copolymer of polystyrene and polyolefin.

Examples of the aforementioned styrene-type monomers include styrene, o-methylstyrene, m-methylstyrene, p-methylstyrene, α-methylstyrene, p-ethylstyrene, 2,4-dimethylstyrene, p-n-butylstyrene, p-t-butylstyrene, p-n-hexylstyrene, p-n-octylstyrene, p-n-dodecylstyrene, p-methoxystyrene, p-phenylstyrene, p-chlorostyrene and 3,4-dichlorostyrene.

Examples of the aforementioned (meth)acrylic ester monomers include (meth)acrylic esters such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, methyl methacrylate, ethyl methacrylate, propyl methacrylate, n-butyl methacrylate, isobutyl methacrylate, n-octyl methacrylate, dodecyl methacrylate, and stearyl methacrylate; and also 2-chloroethyl acrylate, phenyl acrylate, methyl α-chloro arylate, phenyl methacrylate, dimethylaminoethyl methacrylate, 2-hydroxyethyl methacrylate, glycidyl methacrylate, bisglycidyl methacrylate, polyethyleneglycol dimethacrylate and methacryloxyethyl phosphate.

Of these, more preferably used are ethyl acrylate, propyl acrylate, butyl acrylate, methyl methacrylate, ethyl methacrylate, propyl methacrylate and butyl methacrylate.

Other vinyl-type monomers can be added to the aforementioned vinyl-type copolymer.

Examples of the other vinyl type monomers include acrylic acid and its α- or β-alkyl derivatives such as acrylic acid, methacrylic acid, α-ethyl acrylic acid and crotonic acid; unsaturated dicarboxylic acids as well as their monoester derivatives and diester derivatives such as fumaric acid, maleic acid, citraconic acid and itaconic acid;

and also monoacryloyloxyethyl succinate, monomethacryloyloxyethyl succinate, acrylonitrile, methacrylonitrile and acrylamide. They can be used either separately or in combinations of two or more.

For the aforementioned vinyl-type copolymer, those which have at least one peak value in both the range of 5,000–20,000 and the range of 500,000 or higher in the molecular weight distribution curve measured by gel permeation chromatography are used.

If the aforementioned peak value is in the molecular weight range lower than 5,000, then the strength of the toner resin composition decreases. If the peak value exists only in the molecular weight range higher than 20,000 and not in the molecular weight range 20,000 or lower, then there are adverse effects on the fixability.

Also, if the peak value exists only in the molecular weight range lower than 50,000 and not in the molecular weight range 50,000 or higher, then there are adverse effects on the anti-offset properties.

The peak values in the molecular weight distribution curve of the aforementioned vinyl-type copolymer are calculated by with a computer, for example, using the molecular weight distribution curve obtained by GPC. This GPC is usually measured by using HTR-C from Nihon Millipore Limited for the apparatus and one KF-800P, two KF-806Ms and one KF-802 serially connected for the columns.

For the measurement conditions, the temperature is 40° C., the sample concentration is 0.2 wt % in a THF solution (passed through a 0.45 $\mu$m filter), and the injected amount is 100 $\mu$l. Standard polystyrene is used for the calibration sample.

When polymerizing the aforementioned vinyl-type copolymer it is preferable to use an aliphatic hydrocarbon peroxide-type polymerization starter. Use of an aromatic hydrocarbon peroxide-type polymerization starter is not desirable in view of safety and health because benzene may be produced as a by-product in the polymerization. The residual amount of benzene in the toner resin composition or toner of the present invention is preferably 5 ppm or less.

Examples of the aforementioned aliphatic hydrocarbon peroxide-type polymerization starter include alkylperoxy esters such as $\alpha$-cumil peroxyneodecanoate, t-butyl peroxineodecanoate, t-butyl peroxy2-ethylhexanoate, t-butyl peroxyisobutylate, and t-butyl peroxyacetate; dialkylperoxides such as dicumilperoxide, di-t-butylperoxide, and di-t-amylperoxide; peroxyketals such as 1,1-di(t-butylperoxy) cyclohexane, 2,2-di(t-butylperoxy) butane, and 1,1-di(t-amylperoxy) cyclohexane; keton peroxides such as methylethyl ketone peroxide and acetylacetone peroxide; peroxydicarbonates such as di(2-ethylhexyl) peroxydicarbonate and di(s-butyl) peroxydicarbonate; alkylhydro peroxides such as t-butyl hydroperoxide and t-amyl hydroperoxide; and diacyl peroxides such as diisonoanyl peroxide and dilauroyl peroxide.

For the low-melting-point crystalline compound used in the present invention, the weight average molecular weight is preferably 400–2,000, and more preferably 450–850.

If the weight average molecular weight becomes less than 400, then the shelf stability may decrease. If it is more than 2,000, then the fixability may be affected.

The temperature of the heat absorption peak associated with the melting of the aforementioned low-melting-point crystalline compound (measured by means of DSC) is preferably 70–120° C.

If the temperature of the heat absorption peak is less than 70° C., then the self stability may decrease to cause blocking during ordinary temperature storage. If it is higher than 120° C., then the melting during the fixing process becomes harder and the fixability may decrease.

The aforementioned temperature of the heat absorption peak is measured by using a DSC ("DSC220" from Seiko Electronics Industries, for example) at a temperature rising rate of 10° C./minute.

The melt viscosity in 140° C. of the aforementioned low-melting-point crystalline compound is preferably 5–20 cps. If the melt viscosity is less than 5 cps, then there may be an adverse effect on the shelf stability. If it is more than 20 cps, then the fixability may decrease.

The aforementioned melt viscosity is measured according to JIS K 6862.

Examples of such a low-melting-point crystalline compound include low molecular weight crystalline compounds, waxes, and crystalline polymers.

Examples of the aforementioned low molecular weight crystalline compound include higher alcohols such as 1-hexadecanol, 1-heptadecanol, stearyl alcohol, 1-nonadecanol, 1-eicosanol, 1-docosanol, 1-tricosanol, 1-tetracosanol, and seryl alcohol; higher fatty acids such as palmitic acid, heptadecanoic acid, stearic acid, nonadecanoic acid, eicosic acid, behenic acid, tricosic acid, and lignoceric acid, as well as their esters; fatty acid amides such as linolic acid amide, ricinoleic amide, erucic acid amide, oleic acid amide, eicosanoleic amide, erucitic acid amide, and palmitreic acid amide; and n-paraffin with a carbon number of 21 or more.

Examples of the aforementioned waxes include animal waxes such as bees wax and whale wax; plant waxes such as carnauba wax, candelilla wax, and Japanese wax; petroleum waxes such as paraffin wax and microcrystalline wax; and synthetic hydrocarbons such as Fisher-Tropsh wax, polyethylene wax, and polypropylene wax.

Examples of the aforementioned crystalline polymer include polyesters obtained by condensation polymerization of polyol such as ethylene glycol, 1,3-propylene glycol, 1,4-butanediol, 1,5-pentanediol, 1,6-hexane diol, hexamethylene glycol, and tetramethylene glycol with polybasic acid such as fumaric acid, maleic acid, itaconic acid, terephthalic acid, succinic acid, adipic acid, and sebacic acid; polyethers such as polyethylene glcyol and polypropylene glycol; and vinyl-type polymers which contain, as main polymerization units, long-chain alkyl esters such as behenyl alkylate, behenyl methacrylate, behenyl itaconate, and stearyl itaconate.

Of the aforementioned low-melting-point crystalline compounds, waxes are particularly preferable. Since the molecular weight and the dispersibility are limited due to the necessity to satisfy both the low temperature fixability and the anti-offset property, paraffin wax, ethylene wax, propylene wax, etc. are preferably used, and Fisher-Tropsh wax is particularly preferable.

The aforementioned Fisher-Tropsh wax is a synthetic wax synthesized by hydrogenation of carbon monoxide, using coal, natural gas, etc. as the raw material. It can be fractionated by means of distillation before use.

The aforementioned crystalline compound can be used either independently or in combinations of two or more.

The content of the aforementioned crystalline compound is preferably 2–10 weight parts for 100 weight part of the aforementioned vinyl-type copolymer. If the content is less than 2 weight parts, then sufficient low temperature fixability may not be obtained. If it is more than 10 weight parts, then the shelf stability may decrease.

In the aforementioned toner resin composition, the aforementioned vinyl-type copolymer and the low-melting-point crystalline compound form a domain-matrix structure. When domains formed by the low-melting-point crystalline compound are observed through a transmission-type electron microscope, the average particle area occupied by the low-melting-point crystalline compound in any 25 $\mu$m×25 $\mu$m is a 0.5–20 $\mu m^2$, and preferably 0.7–10 $\mu m^2$. If the average particle area is less than 0.5 $\mu m^2$, then the anti-offset effect cannot be obtained. If it is more than 20 $\mu m^2$, then the fluidity and the shelf stability decrease.

The maximum particle area should be 30 $\mu m^2$ or less, because the fluidity and the shelf stability decrease if it exceeds 30 $\mu m^2$.

For the block copolymer of polystyrene and polyolefin used in the present invention, those with a styrene content of 20–80 wt % and a number average molecular weight in styrene equivalent of 1,000–150,000 are preferable.

If the aforementioned styrene content is less than 20 wt %, then the affinity with the aforementioned vinyl-type copolymer decreases and therefore the dispersibility of the low-melting-point crystalline compound as described below may decrease. If the aforementioned styrene content is more than 80 wt %, then the affinity with the low-melting-point crystalline compound as described below decreases and therefore the dispersibility of the wax may decrease.

If the number average molecular weight in styrene equivalent of the aforementioned block copolymer is less than 1,000, then the glass transition point of the aforementioned vinyl-type copolymer decreases and the shelf stability may decrease. If the number average molecular weight in styrene equivalent exceeds 150,000, then the fixability and the crushability at the time of making toner become poor and productivity may decrease.

The aforementioned block copolymer can be obtained by means of, for example, living polymerization.

For polyolefin, which is an ingredient of the block copolymer, di-ene-type monomers are preferable for the start monomers. Examples include butadiene and isoprene. The synthesized block copolymer still has double bonds in the form of 1,4 type or 1,2 type bonds. Compounds obtained by hydrogenating these bonds can also be used.

As described above, the polyolefin block can have various structures and there is no particular limitation. More preferable is the 1,4-butadiene hydrogenated.

The content of the aforementioned block copolymer is 0.5–5 weight parts for 100 weight parts of the vinyl-type copolymer.

If the content of the aforementioned block copolymer is less than 0.5 weight parts, then the dispersibility of the low-melting-point crystalline compound decreases and the shelf stability may decrease.

If the content of the block copolymer is more than 5 weight parts, then the fixability and the crushability at the time of making toner become poor and productivity may decrease.

For better shelf stability, the glass transition point of the toner resin composition of the present invention should preferably be 50° C. or higher. For better fixability, the flow softening point should preferably be 130° C. or less.

The toner resin composition of the present invention can be prepared, for example, by mixing the aforementioned vinyl-type copolymer, the low-melting-point crystalline compound and the block copolymer of polystyrene and polyolefin, and melt-kneading the mixture with a roll-mill, kneader, extruder, etc.

Methods of preparing the toner resin composition other than the method mentioned above include a method in which, in the polymerization process of the aforementioned vinyl-type copolymer, the aforementioned low-melting-point crystalline compound and the block copolymer are added before, during, or after the polymerization.

For the polymerization method, solution polymerization, suspension polymerization, bulk polymerization, etc. can be adopted. It is particularly preferable to add the block copolymer before the polymerization, when the dispersibility of the low-melting-point crystalline compound is the best, and then carry out the solution polymerization.

The toner of the present invention can be prepared, for example, by dispersing a coloring agent, an electric charge control agent, and, as necessary, magnetic particles and such, followed by heat melt-kneading and crushing.

Examples of the aforementioned coloring agent include carbon black, chrome yellow, aniline black, phthalocyanine blue, quinoline yellow, lamp black, rhodamine B, and quinaclidone. The content of the coloring agent is preferably 1–10 weight parts for 100 weight parts of the aforementioned toner resin composition.

For the aforementioned electric charge control agent, there are those for the positive electric charge and those for the negative electric charge.

Examples of those for the positive electric charge include nigrosine dye, ammonium salt, and azine. Examples of those for the negative electric charge include chrome complex and iron complex.

The content of the electric charge control agent is preferably 1–10 weight parts for 100 weight parts of the aforementioned toner resin composition.

For the separability agent in toner preparation, usually polypropylene wax, for example, is dispersed by means of mixing and melting. However, since the toner resin composition of the present invention contains a low-melting-point crystalline compound, it was shown to exhibit sufficient separating effects without using polypropylene wax. However, there is no problem in using polypropylene wax as necessary, and, for actual use, it is preferable to introduce polypropylene wax at the time of preparation of the toner resin composition from the point of view of dispersibility.

The toner thus obtained can additionally have a fluidizing agent to increase the powder fluidity. Examples of such fluidizing agent include hydrophobic silica powder, acrylic resin powder, fluoro resin powder, and higher fatty acid metal salt powders.

In the toner which users the toner resin composition of the present invention, the vinyl-type copolymer and the low-melting-point crystalline compound form a domain-matrix structure. When the domains formed by the low-melting-point crystalline compound are observed through a transmission-type electron microscope, the average particle area occupied by the low-melting-point crystalline compound in any 25 $\mu$m×25 $\mu$m area is 0.5–50 $\mu m^2$, and preferably 0.7–30 $\mu m^2$.

If the average particle area is less than 0.5 $\mu m^2$, then the anti-offset effect can be obtained. If it is more than 50 $\mu m^2$, then the fluidity and the shelf stability decrease. The maximum particle area should be 150 $\mu m^2$ or less, because the fluidity and the shelf stability decrease if it exceeds 150 $\mu m^2$.

(Actions)

The toner resin composition and toner of the present invention allow easy control of the dispersion of the low-melting-point crystalline compound in the toner because the low-melting-point crystalline compound in the vinyl-type copolymer is finely dispersed due to the presence of the block copolymer of polystyrene and polyolefin and therefore has superior anti-offset properties, fixability, and shelf stability. Since the low-melting-point crystalline compound and the block copolymer do not bond chemically, the degree of crystallization does not decrease.

Conventionally, toner which had the domain-matrix structure of the low-melting-point crystalline compound and the resin component, particularly when it was used for low temperature fixing, had weak toner strength due to its weak interface, and the toner on the sleeve cracked due to friction with the blade and such, rendering it unsuitable as a toner for one-component development.

However, since the area of the domains in the domain-matrix structure of the toner is controlled as described in the present invention, the toner strength improves and the toner becomes sufficient for use as a toner for one-component development.

The toner resin composition and the toner of the present invention are described above. The toner resin composition is composed of a vinyl-type copolymer which has styrene-type monomers and (meth)acrylic ester-type monomers as the main ingredients, a low-melting-point crystalline compound, and a block compolymer of polystyrene and polyolefin. Since the vinyl-type copolymer has at least one peak value in both the range of 5,000–20,000 and the range of 500,000 or higher in the molecular weight distribution curve, superior anti-offset properties, fixability, and shelf stability are achieved. Also, the specific domain-matrix structure formed by the vinyl-type copolymer and low-melting-point crystalline compound allows it to be used also as a toner for one-component development.

Moreover, by using a vinyl-type copolymer polymerized by using an aliphatic hydrocarbon peroxide type polymerization starter, the dispersibility of the low-melting-point crystalline compound improves and a toner resin composition and toner with super shelf stability can be obtained.

EXAMPLES

Examples and Comparative examples of the present invention are shown below.

Example 1

30 weight parts of a vinyl-type copolymer with a peak molecular weight value of 500,000 obtained by polymerizing a mixture composed of 80 wt % styrene and 20 wt % N-butyl acrylate, 4 weight parts of the low-melting-point crystalline compound (A) shown in Table 1, 1 weight part of the block copolymer of polystyrene and polyolefin (a) shown in Table 2, and 100 weight parts of toluene were put into a flask and dissolved. After purging the inside of the flask with nitrogen gas, the temperature was raised to the boiling point of toluene. As toluene was refluxing and the mixture was being stirred, a mixture of 50 weight parts of styrene, 15 weight parts of N-butyl acrylate and 3.8 weight parts of benzoyl peroxide (polymerization starter) was dripped into it over a period of three hours to carry out the coexistent solution polymerization. After completion of the dripping, stirring continued with toluene refluxing for one more hour for maturation, and a low molecular weight polymer with a molecular weight peak value of 8,000 was polymerized.

The temperature in the flask was then gradually raised up to 180° C. at a reduced pressure to remove toluene and obtain a resin. After cooling, this resin was crushed to obtain the toner resin composition of the present invention.

100 weight parts of the aforementioned toner resin composition, 1.5 weight parts of a chrome gold-containing dye ("S-34" from Orient Chemical Industries, Ltd.), and 6.5 weight parts of carbon black ("MA-100" and Mitsubishi Chemical Corporation) were mixed and melt-kneaded at a rotating speed of 96 rpm and at 150° C. using a dual-axle kneader ("S1KRC KNEADER" from Kurimoto Ltd.), and then crushed with a jet-mill ("Labojet" from Nippon Pneumatical Mfg. Co., Ltd.) to obtain toner particles with an average particle size of approximately 10 $\mu$m.

0.3 wt % of hydrophobic silica powder ("R972" from Aerosil Japan) was added to those toner particles to obtain the toner.

Example 2

100 weight parts of the same toner resin composition as in Example 1, 1.5 weight parts of CCA ("BONTRON N-01" from Orient Chemical Industries, Ltd.), and 100 weight parts of magnetic particles ("KBC-100S" from Kanto Denka Kogyo Co., Ltd.) were mixed and melt-kneaded at a rotating speed of 96 rpm and at 150° C. using a dual-axle kneader ("S1KRC KNEADER" from Kurimoto Ltd.), and then crushed with a jet-mill ("Labojet" from Nippon Pneumatical Mfg. Co., Ltd.) to obtain toner particles with an average particle size of approximate 10 $\mu$m. 0.3 wt % of hydrophobic silica powder ("R972" from Aerosil Japan) was added to these toner particles to obtain the toner.

Example 3

20 weight parts of a vinyl-type copolymer with a peak molecular weight value of 1,500,000 obtained by polymerizing a mixture composed of 70 wt % styrene and 30 wt % N-butyl acrylate, 8 weight parts of the low-melting-point crystalline compound (B) shown in Table 1, 3 weight parts of the block copolymer of polystyrene and polyolefin (b) shown in Table 2, and 100 weight parts of toluene were put into a flask and dissolved. After purging the inside of the flask with nitrogen gas, the temperature was raised to the boiling point of toluene. As toluene was refluxing and the mixture was being stirred, a mixture of 60 weight parts of styrene, 15 weight parts of N-butyl acrylate and 3.2 weight parts of benzoyl peroxide (polymerization starter) was dripped into it over a period of three hours to carry out the coexistent solution polymerization. After completion of the dripping, stirring continued with toluene refluxing for one more hour for maturation, and a low molecular weight polymer with a molecular weight peak value of 15,000 was polymerized.

The temperature in the flask was then gradually raised up to 180° C. at a reduced pressure to remove toluene and obtain a resin. After cooling, this resin was crushed to obtain the toner resin composition of the present invention. Toner was obtained from the aforementioned toner resin composition in the same manner as in Example 1.

Example 4

Toner was obtained in the same manner as in Example 2 except for the fact that the same toner resin composition as in Example 3 was used.

Example 5

30 weight parts of a vinyl-type copolymer with a peak molecular weight value of 500,000 obtained by polymerizing a mixture composed of 80 wt % styrene and 20 wt % N-butyl acrylate, 3 weight parts of the block copolymer of polystyrene and polyolefin (b) shown in Table 2, and 100 weight parts of toluene were put into a flask and dissolved. After purging the inside of the flask with nitrogen gas, the temperature was raised to the boiling point of toluene. As toluene was refluxing and the mixture was being stirred, a mixture of 50 weight parts of styrene, 15 weight parts of N-butyl acrylate and 3.8 weight parts of benzoyl peroxide (polymerization starter) was dripped into it over a period of three hours to carry out the coexistent solution polymerization.

After completion of the dripping, stirring continued with toluene refluxing for one more hour for maturation, and a low molecular weight polymer with a molecular weight peak value of 8,000 was polymerized.

The temperature in the flask was then gradually raised up to 180° C. at a reduced pressure to remove toluene and obtain a resin. After cooling, this resin was crushed to obtain the toner resin composition of the present invention.

100 weight parts of the aforementioned toner resin composition, 1.5 weight parts of a chrome gold-containing dye ("S-34" from Orient Chemical Industries, Ltd.), and 6.5 weight parts of carbon black ("MA-100" from Mitsubishi Chemical Corporation) were mixed and melt-kneaded at a rotating speed of 96 rpm and at 150° C. using a dual-axle kneader ("S1KRC KNEADER" from Kurimoto Ltd.), and then crushed with a jet-mill ("Labojet" from Nippon Pneumatical Mfg. Co., Ltd.) to obtain toner particles with an average particle size of approximately 10 μm.

0.3 wt % of hydrophobic silica powder ("R972" from Aerosil Japan) was added to these toner particles to obtain the toner.

Example 6

100 weight parts of the same toner resin composition as in Example 5, 8 weight parts of the low-melting-point crystalline compound (A) shown in Table 1, 1.5 weight parts of CCA ("BONTRON N-01" from Orient Chemical Industries, Ltd.), and 100 weight parts of magnetic particles ("KBC-100S" from Kanto Denka Kogyo Co., Ltd.) were mixed and melt-kneaded at a rotating speed of 96 rpm and at 150° C. using a dual-axle kneader ("S1KRC KNEADER" from Kurimoto Ltd.), and then crushed with a jet-mill ("Labojet" from Nippon Pneumatical Mfg. Co., Ltd.) to obtain toner particles with an average particle size of approximately 10 μm. 0.3 wt % of hydrophobic silica powder ("R972" from Aerosil Japan) was added to these toner particles to obtain the toner.

Example 7

30 weight parts of a vinyl-type copolymer with a peak molecular weight value of 500,000 obtained by polymerizing a mixture composed of 80 wt % styrene and 20 wt % N-butyl acrylate, 8 weight parts of the low-melting-point crystalline compound (E) shown in Table1, 1 weight part of the block copolymer of polystyrene and polyolefin (a) shown in Table 2, and 100 weight parts of toluene were put into a flask and dissolved. After purging the inside of the flask with nitrogen gas, the temperature was raised to the boiling point of toluene. As toluene was refluxing and the mixture was being stirred, a mixture of 50 weight parts of styrene, 15 weight parts of N-butyl acrylate and 3.8 weight parts of benzoyl peroxide (polymerization starter) was dripped into it over a period of three hours to carry out the coexistent solution polymerization. After completion of the dripping, stirring continued with toluene refluxing for one more hour for maturation, and a low molecular weight polymer with a molecular weight peak value of 8,000 was polymerized.

The temperature in the flask was then gradually raised up to 180° C. at a reduced pressure to remove toluene and obtain a resin. Toner was obtained in the same manner as in Example 2 except for the fact that this toner resin composition is used.

Example 8

20 weight parts of a vinyl-type copolymer with a peak molecular weight value of 1,500,000 obtained by polymerizing a mixture composed of 70 wt % styrene and 30 wt % N-butyl acrylate, 8 weight parts of the low-melting-point crystalline compound (F) shown in Table1, 3 weight parts of the block copolymer of polystyrene and polyolefin (b) shown in Table 2, and 100 weight parts of toluene were put into a flask and dissolved. After purging the inside of the flask with nitrogen gas, the temperature was raised to the boiling point of toluene. As toluene was refluxing and the mixture was being stirred, a mixture of 60 weight parts of styrene, 15 weight parts of N-butyl acrylate and 3.8 weight parts of benzoyl peroxide (polymerization starter) was dripped into it over a period of three hours to carry out the coexistent solution polymerization. After completion of the dripping, stirring continued with toluene refluxing for one more hour for maturation, and a low molecular weight polymer with a molecular weight peak value of 15,000 was polymerized.

The temperature in the flask was then gradually raised up to 180° C. at a reduced pressure to remove toluene and obtain a resin. Toner was obtained in the same manner as in Example 2 except for the fact that this toner resin composition is used.

Example 9

100 weight parts of the same toner resin composition as in Example 5, 8 weight parts of the low-melting-point crystalline compound (E) shown in Table 1, 1.5 weight parts of CCA ("BONTRON N-01" from Orient Chemical Industries, Ltd.), and 100 weight parts of magnetic particles ("KBC-100S" from Kanto Denka Kogyo Co., Ltd.) were mixed and melt-kneaded at a rotating speed of 96 rpm and at 150° C. using a dual-axle kneader ("S1KRC KNEADER" from Kurimoto Ltd.), and then crushed with a jet-mill ("Labojet" from Nippon Pneumatical Mfg. Co., Ltd.) to obtain toner particles with an average particle size of approximately 10 μm. 0.3 wt % of hydrophobic silica powder ("R972" from Aerosil Japan) was added to these toner particles to obtain the toner.

Comparative Example 1

40 weight parts of a vinyl-type copolymer with a peak molecular weight value of 300,000 obtained by polymerizing a mixture composed of 80 wt % styrene and 20 wt % N-butyl acrylate, 1 weight part of the low-melting-point crystalline compound (C) shown in Table1, 0.1 weight part of the block copolymer of polystyrene and polyolefin (d) shown in Table 2, and 100 weight parts of toluene were put into a flask and dissolved. After purging the inside of the flask with nitrogen gas, the temperature was raised to the boiling point of toluene. As toluene was refluxing and the mixture was being stirred, a mixture of 50 weight parts of styrene, 10 weight parts of N-butyl acrylate and 5.5 weight parts of benzoyl peroxide (polymerization starter) was dripped into it over a period of three hours to carry out the coexistent solution polymerization. After completion of the dripping, stirring continued with toluene refluxing for one more hour for maturation, and a low molecular weight polymer with a molecular weight peak value of 4,000 was polymerized.

The temperature in the flask was then gradually raised up to 180° C. at a reduced pressure to remove toluene and obtain a resin. Toner was obtained in the same manner as in Example 1 except for the fact that this toner resin composition is used.

Comparative Example 2

Toner was obtained in the same manner as in Example 2 except for the fact that the same toner resin composition as in Comparative example 1 was used.

Comparative Example 3

40 weight parts of a vinyl-type copolymer with a peak molecular weight value of 300,000 obtained by polymerizing a mixture composed of 80 wt % styrene and 20 wt % N-butyl acrylate, 12 weight part of the low-melting-point crystalline compound (D) shown in Table1, 10 weight parts of the block copolymer of polystyrene and polyolefin (c) shown in Table 2, and 100 weight parts of toluene were put into a flask and dissolved. After purging the inside of the flask with nitrogen gas, the temperature was raised to the boiling point of toluene. As toluene was refluxing and the mixture was being stirred, a mixture of 32 weight parts of styrene, 5 weight parts of N-butyl acrylate and 1 weight parts of benzoyl peroxide (polymerization starter) was dripped into it over a period of three hours to carry out the coexistent solution polymerization. After completion of the dripping, stirring continued with toluene refluxing for one more hour for maturation, and a low molecular weight polymer with a molecular weight peak value of 50,000 was polymerized.

The temperature in the flask was then gradually raised up to 180° C. at a reduced pressure to remove toluene and obtain a resin. After cooling, this resin was crushed to obtain the toner resin composition of the present invention. Toner was obtained from the aforementioned toner resin composition in the same manner as in Example 1 except for the fact that this toner resin composition is used. However, the crushing efficiency decreased when the toner was crushed, and the productivity was not very good.

Comparative Example 4

Toner was obtained in the same manner as in Example 2 except for the fact that the same toner resin composition as in Comparative example 3 was used. However, the crushing efficiency decreased when the toner was crushed, and the productivity became poor.

Comparative Example 5

Toner was obtained in the same manner as in Example 1 except for the fact that the block copolymer of polystyrene and polyolefin was not used at all.

Comparative Example 6

Toner was obtained in the same manner as in Example 2 except for the fact that the block copolymer of polystyrene and polyolefin was not used at all.

Comparative Example 7

Toner was obtained in the same manner as in Example 7 except for the fact that the block copolymer of polystyrene and polyolefin was not used at all.

TABLE 1

| Type | Ingredient | Mw | Melt viscosity (cps) at 180° C. | DSC melting point (° C.) |
|---|---|---|---|---|
| A | Fisher-Tropsh wax | 670 | 6 | 98 |
| B | Fisher-Tropsh wax | 1000 | 10 | 107 |
| C | Fisher-Tropsh wax | 300 | 3 | 65 |
| D | Polypropylene | 2500 | 1800 | 160 |
| E | Paraffin | 520 | 5 | 77 |
| F | Paraffin | 630 | 10 | 83 |

TABLE 2

| Type | Ingredient | Styrene content (wt %) | Average molecular weight in styrene equivalent |
|---|---|---|---|
| a | St/isoprene hydrogenated/St triblock | 65 | 60,000 |
| b | St/butadiene hydrogenated diblock | 30 | 75,000 |
| c | St/isoprene hydrogenated/St triblock | 10 | 300,000 |
| d | St/butadiene hydrogenated diblock | 90 | 500 |

St: Styrene

TABLE 3

| | Composition of the vinyl-type copolymer (wt %) | | Molecular weight of the vinyl-type copolymer | |
|---|---|---|---|---|
| | Styrene | N-butyl acrylate | Peak value 1 | Peak value 2 |
| Example 1 | 80 | 20 | 8,000 | 500,000 |
| Example 2 | 70 | 30 | 15,000 | 500,000 |
| Example 3 | 70 | 30 | 8,000 | 1,500,000 |
| Example 4 | 70 | 30 | 8,000 | 1,500,000 |
| Example 5 | 80 | 20 | 8,000 | 500,000 |
| Example 6 | 80 | 20 | 8,000 | 500,000 |
| Example 7 | 70 | 30 | 8,000 | 500,000 |
| Example 8 | 70 | 30 | 15,000 | 1,500,000 |
| Example 9 | 70 | 30 | 8,000 | 1,500,000 |
| Comparative example 1 | 80 | 20 | 4,000 | 300,000 |
| Comparative example 2 | 80 | 20 | 4,000 | 300,000 |
| Comparative example 3 | 80 | 20 | 50,000 | 300,000 |
| Comparative example 4 | 80 | 20 | 50,000 | 300,000 |
| Comparative | 80 | 20 | 8,000 | 500,000 |

TABLE 3-continued

| | Composition of the vinyl-type copolymer (wt %) | | Molecular weight of the vinyl-type copolymer | |
|---|---|---|---|---|
| | Styrene | N-butyl acrylate | Peak value 1 | Peak value 2 |
| example 5 | | | | |
| Comparative example 6 | 70 | 30 | 15,000 | 500,000 |
| Comparative example 7 | 70 | 30 | 8,000 | 500,000 |

Peak value 1: 5,000–20,000, Peak value 2: 500,000 or higher

TABLE 4

| | Toner resin composition (weight parts) | | |
|---|---|---|---|
| | Vinyl-type copolymer | Low-melting-point crystalline compound (type) | Block copolymer (type) |
| Example 1 | 30 | 4 (A) | 1 (a) |
| Example 2 | 30 | 4 (A) | 1 (a) |
| Example 3 | 20 | 8 (B) | 3 (b) |
| Example 4 | 20 | 8 (B) | 3 (b) |
| Example 5 | 30 | — | 3 (b) |
| Example 6 | 30 | — | 3 (b) |
| Example 7 | 30 | 8 (E) | 1 (a) |
| Example 8 | 20 | 8 (F) | 3 (b) |
| Example 9 | 30 | — | 3 (b) |
| Comparative example 1 | 40 | 1 (C) | 0.1 (d) |
| Comparative example 2 | 40 | 1 (C) | 0.1 (d) |
| Comparative example 3 | 40 | 12 (D) | 10 (c) |
| Comparative example 4 | 40 | 12 (D) | 10 (c) |
| Comparative example 5 | 30 | 4 (A) | — |
| Comparative example 6 | 30 | 4 (A) | — |
| Comparative example 7 | 30 | 8 (E) | — |

The toners obtained in the aforementioned Examples and Comparative examples were tested for their performance in regard to the following items and the evaluation results are shown in Table 5 and Table 6.

(1) Dispersibility

Toner lumps obtained during the melt-kneading stage in the toner preparation process were dyed with Ru04 and then a microtome was used to make thin film pieces with a thickness of approximately 0.5 μm. A transmission-type electron microscope was used to take pictures of the dispersion state of the low-melting-point crystalline compound. The obtained transmission-type electron microscopic photographs were used to measure the average particle area occupied by the low-melting-point crystalline compound in any 25 μm×25 μm area.

(2) Fixability 6.5 weight parts of the toner and 93.5 weight parts of iron powder carrier with an average particle size of approximately 50–80 μm were mixed to prepare a developing agent, and this developing agent was used to obtain multiple unfixed image copies.

The surface temperature of the heat fixing roll was then set at 150° C. and 170° C., and fixation of the toner images on the sheets on which the aforementioned unfixed images were formed was carried out.

The electronic photocopier used was "U-BIX4160AF" from Konica Corporation with some modifications. The fixed images thus formed were rubbed with cotton pads and the following equation was used to calculate the fixation strength, which was used as an index of the low energy fixability.

Fixation strength (%)=[(image density of fixed imaged after rubbing)/(image density of fixed imaged before rubbing)]×100

Where, the image density was measured by using a reflection densitometer ("RD-914" from Macbeth).

(3) Offset properties

The surface temperature of the heat fixation roll was varied in steps and, at each temperature, copies were made by fixing the toner images on the sheets which had the aforementioned unfixed images on them.

Observations were made to see whether the blank portions had toner stains. The non-offset temperature region was defined as a temperature region where stains did not show. The non-offset temperature width was defined as the difference between the maximum and minimum values of the non-offset temperature region.

(4) Shelf stability 20 g of the toner was put into a 200 ml sample bottle and, after allowing it to stand for 48 hours in a constant temperature bath at 50° C., sifted using a powder tester ("PT-E type" from Hosokawa Micron, Ltd.) for 10 seconds with an amplitude of 1 mm. Using a sieve with an aperture of 250 μm, a residual amount of 1 g or less was accepted, indicated by "○", and a residual amount of more than 1 g was not accepted, indicated by "X".

TABLE 5

| | Toner resin composition | | Toner | |
|---|---|---|---|---|
| | Average particle area ($\mu m^2$) | Maximum particle area ($\mu m^2$) | Average particle area ($\mu m^2$) | Maximum particle area ($\mu m^2$) |
| Example 1 | 5.0 | 13.0 | 3.0 | 10.0 |
| Example 2 | 5.0 | 13.0 | 3.0 | 10.0 |
| Example 3 | 4.0 | 9.0 | 1.0 | 6.0 |
| Example 4 | 4.0 | 9.0 | 1.0 | 6.0 |
| Example 5 | — | — | 10.0 | 20.0 |
| Example 6 | — | — | 10.0 | 20.0 |
| Example 7 | 6.0 | 20.0 | 3.5 | 15.0 |
| Example 8 | 2.0 | 10.0 | 1.2 | 8.0 |
| Example 9 | — | — | 9.0 | 20.0 |
| Comparative example 1 | 30.0 | 50.0 | 22.0 | 40.0 |
| Comparative example 2 | 30.0 | 50.0 | 22.0 | 40.0 |
| Comparative example 3 | 0.2 | 1.0 | 0.1 | 0.5 |
| Comparative example 4 | 0.2 | 1.0 | 0.1 | 0.5 |
| Comparative example 5 | 34.0 | 55.0 | 25.0 | 45.0 |
| Comparative example 6 | 34.0 | 55.0 | 25.0 | 45.0 |
| Comparative example 7 | 30.0 | 54.0 | 23.0 | 46.0 |

TABLE 6

| | Non-offset temperature region (° C.) | Non-offset temperature width (° C.) | Fixation strength (%) 150° C. | Fixation strength (%) 170° C. | Shelf stability |
|---|---|---|---|---|---|
| Example 1 | 140–210 ↑ | 70 ↑ | 75 | 88 | ○ |
| Example 2 | 140–210 ↑ | 70 ↑ | 75 | 88 | ○ |
| Example 3 | 140–210 ↑ | 70 ↑ | 76 | 88 | ○ |
| Example 4 | 140–210 ↑ | 70 ↑ | 76 | 88 | ○ |
| Example 5 | 140–210 ↑ | 70 ↑ | 75 | 90 | ○ |
| Example 6 | 140–210 ↑ | 70 ↑ | 75 | 90 | ○ |
| Example 7 | 140–210 ↑ | 70 ↑ | 75 | 88 | ○ |
| Example 8 | 140–210 ↑ | 70 ↑ | 76 | 88 | ○ |
| Example 9 | 140–210 ↑ | 70 ↑ | 75 | 90 | ○ |
| Comparative example 1 | 140–180 | 40 | 70 | 77 | X |
| Comparative example 2 | 140–180 | 40 | 70 | 77 | X |
| Comparative example 3 | 155–190 | 35 | — | 70 | X |
| Comparative example 4 | 155–190 | 35 | — | 70 | X |
| Comparative example 5 | 140–190 | 50 | 75 | 88 | x |
| Comparative example 6 | 140–190 | 50 | 75 | 88 | X |
| Comparative example 7 | 140–190 | 50 | 75 | 88 | X |

↑: indicates that the temperature is the value shown or higher.

Example 10

30 weight parts of a vinyl-type copolymer with a peak molecular weight value of 500,000 obtained by polymerizing a mixture composed of 80 wt % styrene and 20 wt % N-butyl acrylate, 4 weight parts of the low-melting-point crystalline compound (A) shown in Table1, 1 weight part of the block copolymer of polystyrene and polyolefin (a) shown in Table 2, and 100 weight parts of toluene were put into a flask and dissolved. After purging the inside of the flask with nitrogen gas, the temperature was raised to the boiling point of toluene. As toluene was refluxing and the mixture was being stirred, a mixture of 50 weight parts of styrene, 15 weight parts of N-butyl acrylate and 4 weight parts of t-butyl peroxy-2-ethylhexanoate (polymerization starter) was dripped into it over a period of three hours to carry out the coexistent solution polymerization. After completion of the dripping, stirring continued with toluene refluxing for one more hour for maturation, and a low molecular weight polymer with a molecular weight peak value of 8,000 was polymerized.

The temperature in the flask was then gradually raised to 180° C. at a reduced pressure to remove toluene and the toluene removal was continued for an hour with a pressure reduction of 720 mmHg or more to obtain a resin. After cooling, this resin was crushed to obtain the toner resin composition of the present invention.

Toner was obtained in the same manner as in Example 2 except for the fact that this toner resin composition was used.

Example 11

20 weight parts of a vinyl-type copolymer with a peak molecular weight value of 1,500,000 obtained by polymerizing a mixture composed of 70 wt % styrene and 30 wt % N-butyl acrylate, 8 weight parts of the low-melting-point crystalline compound (B) shown in Table1, 3 weight parts of the block copolymer of polystyrene and polyolefin (b) shown in Table 2, and 100 weight parts of toluene were put into a flask and dissolved. After purging the inside of the flask with nitrogen gas, the temperature was raised to the boiling point of toluene. As toluene was refluxing and the mixture was being stirred, a mixture of 60 weight parts of styrene, 15 weight parts of N-butyl acrylate and 3.3 weight parts of t-butyl peroxy neoheptanoate (polymerization starter) was dripped into it over a period of three hours to carry out the coexistent solution polymerization. After completion of the dripping, stirring continued with toluene refluxing for one more hour for maturation, and a low molecular weight polymer with a molecular weight peak value of 15,000 was polymerized.

The temperature in the flask was then gradually raised up to 180° C. at a reduced pressure to remove toluene, and the toluene removal was continued for an hour with a pressure reduction of 720 mmHg or more to obtain a resin. After cooling, this resin was crushed to obtain the toner resin composition of the present invention.

Toner was obtained in the same manner as in Example 2 except for the fact that this toner resin composition was used.

Example 12

30 weight parts of a vinyl-type copolymer with a peak molecular weight value of 500,000 obtained by polymerizing a mixture composed of 80 wt % styrene and 20 wt % N-butyl acrylate, 3 weight parts of the block copolymer of polystyrene and polyolefin (b) shown in Table 2, and 100 weight parts of toluene were put into a flask and dissolved. After purging the inside of the flask with nitrogen gas, the temperature was raised to the boiling point of toluene. A toluene was refluxing and the mixture was being stirred, a mixture of 50 weight parts of styrene, 15 weight parts of N-butyl acrylate and 3.3 weight parts of t-butyl peroxy-2-ethylhexanoate (polymerization starter) was dripped into it over a period of three hours to carry out the coexistent solution polymerization. After completion of the dripping, stirring continued with toluene refluxing for one more hour for maturation, and a low molecular weight polymer with a molecular weight peak value of 15,000 was polymerized.

The temperature in the flask was then gradually raised up to 180° C. at a reduced pressure to remove toluene, and the toluene removal was continued for an hour with a pressure reduction of 720 mmHg or more to obtain a resin. After cooling, this resin was crushed to obtain the toner resin composition of the present invention.

Toner was obtained in the same manner as in Example 6 except for the fact that this toner resin composition was used.

Comparative Example 8

40 weight parts of a vinyl-type copolymer with a peak molecular weight value of 300,000 obtained by polymerizing a mixture composed of 80 wt % styrene and 20 wt % N-butyl acrylate, 1 weight part of the low-melting-point crystalline compound (C) shown in Table1, 0.1 weight part of the block copolymer of polystyrene and polyolefin (b) shown in Table 2, and 100 weight parts of toluene were put into a flask and dissolved. After purging the inside of the flask with nitrogen gas, the temperature was raised to the boiling point of toluene. As toluene was refluxing and the mixture was being stirred, a mixture of 50 weight parts of styrene, 10 weight parts of N-butyl acrylate and 5.5 weight parts of benzoyl peroxide (polymerization starter) was dripped into it over a period of three hours to carry out the coexistent solution polymerization. After completion of the dripping, stirring continued with toluene refluxing for one more hour for maturation, and a low molecular weight polymer with a molecular weight peak value of 4,000 was polymerized.

The temperature in the flask was then gradually raised up to 180° C. at a reduced pressure to remove toluene, and the toluene removal was continued for an hour with a pressure reduction of 720 mmHg or more to obtain a resin. After cooling, this resin was crushed to obtain the toner resin composition of the present invention.

Toner was obtained in the same manner as in Example 2 except for the fact that this toner resin composition was used.

Comparative Example 9

40 weight parts of a vinyl-type copolymer with a peak molecular weight value of 300,000 obtained by polymerizing a mixture composed of 80 wt % styrene and 20 wt % N-butyl acrylate, 1 weight part of the low-melting-point crystalline compound (D) shown in Table1, 0.1 weight part of the block copolymer of polystyrene and polyolefin (c) shown in Table 2, and 100 weight parts of toluene were put into a flask and dissolved. After purging the inside of the flask with nitrogen gas, the temperature was raised to the boiling point of toluene. As toluene was refluxing and the mixture was being stirred, a mixture of 32 weight parts of styrene, 5 weight parts of N-butyl acrylate and 1 weight part of benzoyl peroxide (polymerization starter) was dripped into it over a period of three hours to carry out the coexistent solution polymerization. After completion of the dripping, stirring continued with toluene refluxing for one more hour for maturation, and a low molecular weight polymer with a molecular weight peak value of 50,000 was polymerized.

The temperature in the flask was then gradually raised up to 180° C. at a reduced pressure to remove toluene, and the toluene removal was continued for an hour with a pressure reduction of 720 mmHg or more to obtain a resin. After cooling, this resin was crushed to obtain the toner resin composition of the present invention.

Toner was obtained in the same manner as in Example 2 except for the fact that this toner resin composition was used.

Toner was obtained in the same manner as in Example 10 except for the fact that the block copolymer of polystyrene and polyolefin (a) was not used at all and that 3.8 weight parts of bonzoyl peroxide, instead of t-butyl peroxy-2-ethylhexanoate, was used as the polymerization starter.

TABLE 7

| | Composition of the vinyl-type copolymer (wt %) | | Molecular weight of the vinyl-type copolymer | |
|---|---|---|---|---|
| | Styrene | N-butyl acrylate | Peak value 1 | Peak value 2 |
| Example 10 | 80 | 20 | 8,000 | 500,000 |
| Example 11 | 70 | 30 | 15,000 | 1,500,000 |
| Example 12 | 80 | 20 | 15,000 | 500,000 |

TABLE 7-continued

| | Composition of the vinyl-type copolymer (wt %) | | Molecular weight of the vinyl-type copolymer | |
|---|---|---|---|---|
| | Styrene | N-butyl acrylate | Peak value 1 | Peak value 2 |
| Comparative example 8 | 80 | 20 | 4,000 | 300,000 |
| Comparative example 9 | 80 | 20 | 50,000 | 300,000 |
| Comparative example 10 | 80 | 20 | 8,000 | 500,000 |

Peak value 1: 5,000–20,000, Peak value 2: 500,000 or higher

TABLE 8

| | Toner resin composition (weight parts) | | |
|---|---|---|---|
| | Vinyl-type copolymer | Low-melting-point crystalline compound (type) | Block copolymer (type) |
| Example 10 | 30 | 4 (A) | 1 (a) |
| Example 11 | 20 | 8 (B) | 3 (b) |
| Example 12 | 30 | — | 3 (b) |
| Comparative example 8 | 40 | 1 (C) | 0.1 (b) |
| Comparative example 9 | 40 | 1 (D) | 0.1 (c) |
| Comparative example 10 | 30 | 4 (A) | — |

The toners obtained in the aforementioned Examples 10–12 and Comparative examples 8–10 were tested for their performance in items (1)–(4) as in Example 1 as well as in the following item (5), and the evaluation results are shown in Table 9 and Table 10.

(5) Residual amount of benzene 0.30 g of the toner, precisely weighed, was put into a 50 ml vial and sealed, followed by heating at 150° C. for 30 minutes. 1 ml of the gas in the vapor portion was sampled and measured by using a mass spectrometer (HP5890 SERIES II/HP5972).

The standard sample was prepared by adding a prescribed amount of the standard substance (benzene) to the aforementioned sample. The ionization method was the EI method (70 eV). For the column, DB-624 (60 ml×0.32 mmi·d×1.8 $\mu$m) was used. After injecting 1 ml, the sample was held at 35° C. for 3 minutes, the temperature was raised to 60° C. at a temperature raising rate of 2° C./minute, and then the temperature was raised to 230° C. at a temperature raising rate of 20° C./minute for the measurements. The obtained chart was corrected by using the value obtained by the standard sample measurement to obtain the residual amount of benzene.

TABLE 9

| | Toner resin composition | | Toner | | |
|---|---|---|---|---|---|
| | Average particle area ($\mu m^2$) | Maximum particle area ($\mu m^2$) | Average particle area ($\mu m^2$) | Maximum particle area ($\mu m^2$) | Residual amount of benzene (ppm) |
| Example 10 | 5.0 | 13.0 | 3.0 | 10.0 | 1 |
| Example 11 | 3.0 | 9.0 | 1.0 | 6.0 | 2 |
| Example 12 | 15.0 | 25.0 | 10.0 | 20.0 | 1 |
| Comparative example 8 | 35.0 | 60.0 | 22.0 | 40.0 | 7 |
| Comparative example 9 | 0.2 | 1.0 | 0.1 | 0.5 | 2 |
| Comparative example 10 | 37.0 | 65.0 | 25.0 | 45.0 | 9 |

TABLE 10

| | Non-offset temperature region (° C.) | Non-offset temperature width (° C.) | Fixation strength (%) 150° C. | Fixation strength (%) 170° C. | Shelf stability |
|---|---|---|---|---|---|
| Example 10 | 140–210 ↑ | 70 ↑ | 75 | 88 | ○ |
| Example 11 | 140–210 ↑ | 70 ↑ | 76 | 88 | ○ |
| Example 12 | 140–210 ↑ | 70 ↑ | 75 | 90 | ○ |
| Comparative example 8 | 140–180 ↑ | 40 | 70 | 77 | X |
| Comparative example 9 | 155–190 ↑ | 35 | — | 70 | X |
| Comparative example 10 | 140–190 ↑ | 50 | 75 | 88 | X |

↑: indicates that the temperature is the value shown or higher.

What is claimed is:

1. A toner resin composition comprising:

a vinyl-type copolymer, which has styrene-type monomers and (meth)acrylic ester-type monomers as the main ingredients, having at least one peak value on both the range of 5,000–20,000 and the range of 500,000 or higher in the molecular weight distribution curve measured by gel permeation chromatography;

2–10 weight parts of a low-melting-point crystalline compound, for 100 weight parts of said vinyl-type copolymer; and 0.5–5 weight parts of a block copolymer of polystyrene and polyolefin for 100 weight parts of said vinyl-type copolymer, wherein the average particle area of said toner resin composition is 30 $\mu m^2$ or less in any 25 $\mu m \times 25$ $\mu m$ area when transmission electron microscopy is used to observe said low-melting-point crystalline compound which forms domains in the domain-matrix structure formed by said vinyl-type copolymer and the low-melting-point crystalline compound.

2. The toner resin composition of claim 1 wherein the aforementioned vinyl-type copolymer is obtained by polymerizing styrene-type monomers and (meth)acrylic ester-type monomers in the presence of an aliphatic hydrocarbon peroxide-type polymerization starter.

3. The toner resin composition of claim 1 wherein the aforementioned low-melting-point crystalline compound has a weight average molecular weight (Mw) in the range of 400–2,000, a melt viscosity at 140° C. of 5–20 cps, and a heat absorption peak at 70–200° C. due to melting, meaured by differential scanning calorimetry (DSC).

4. The toner resin composition of claim 1 wherein the aforementioned low-melting-point crystalline compound is Fisher-Tropsh wax or paraffin wax.

5. The toner resin composition of claim 1 wherein the aforementioned compound composed of a block copolymer of polystyrene and polyolefin has a styrene content of 20–80 wt % and an average molecular weight in styrene equivalent of 1,000–150,000.

6. The toner resin composition of claim 1 which is characteristically for one-component development.

7. The toner which characteristically uses the toner resin composition of claim 1.

8. A toner comprising:

a vinyl-type copolymer which has styrene-type monomers and (meth)acrylic ester-type monomers as the main ingredients, having at least one peak value in both the range of 5,000–20,000 and the range of 500,000 or higher in the molecular weight distribution curve measured by gel permeation chromatography;

2–10 weight parts of a low-melting-point crystalline compound, for 100 weight parts of said vinyl-type copolymer; and 0.5–5 weight parts of a block copolymer of polystyrene and polyolefin for 100 weight parts of said vinyl-type copolymer, wherein an average particle area of said toner is 0.5–50 $\mu m^2$ and the maximum particle area is 150 $\mu m^2$ or less in any 25 $\mu m \times 25$ $\mu m$ area when transmission electron microscopy is used to observe said low-melting-point crystalline compound which forms domains in the domain-matrix structure formed by said vinyl-type copolymer and the low-melting-point crystalline compound.

9. The toner of claim 7, wherein the average particle area is 0.5–50 $\mu m^2$ and the maximum particle area is 150 $\mu m^2$ or less in any 25 $\mu m \times 25$ $\mu m$ area when transimission electron microscopy is used to observe said low-melting-point crystalline compound which forms domains in the domain-matrix structure formed by said vinyl-type copolymer and the low-melting-point crystalline compound.

10. The toner of claim 7 which is characteristically for one-component development.

11. The toner of claim 8 which is characteristically for one-component development.

12. The toner of claim 9 which is characteristically for one-component development.

* * * * *